US007374156B2

(12) United States Patent
Ooyachi et al.

(10) Patent No.: US 7,374,156 B2
(45) Date of Patent: May 20, 2008

(54) EQUIPMENT AND PROCESS FOR THE PRODUCTION OF CARBONATED WATER

(75) Inventors: Ken Ooyachi, Hiroshima (JP); Hiroki Sakakibara, Tokyo (JP); Satoshi Suzuki, Aichi (JP); Hiroshi Tasaka, Aichi (JP); Masaaki Satou, Aichi (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 93 days.

(21) Appl. No.: 10/551,686

(22) PCT Filed: Mar. 29, 2004

(86) PCT No.: PCT/JP2004/004453

§ 371 (c)(1),
(2), (4) Date: Sep. 30, 2005

(87) PCT Pub. No.: WO2004/089521

PCT Pub. Date: Oct. 21, 2004

(65) Prior Publication Data

US 2006/0202363 A1 Sep. 14, 2006

(30) Foreign Application Priority Data

Apr. 2, 2003 (JP) ..... 2003-099184
Dec. 18, 2003 (JP) ..... 2003-421355

(51) Int. Cl.
*B01F 3/04* (2006.01)

(52) U.S. Cl. ..... 261/36.1; 261/79.2; 261/DIG. 7; 426/477; 366/336

(58) Field of Classification Search ..... 261/36.1, 261/37, 79.2, 113, DIG. 7; 426/474, 477; 366/101, 336, 337–340
See application file for complete search history.

(56) References Cited

U.S. PATENT DOCUMENTS

| | | | | |
|---|---|---|---|---|
| 2,229,441 | A * | 1/1941 | Carlson | 261/75 |
| 3,643,688 | A * | 2/1972 | Meinert | 137/556 |
| 3,761,066 | A * | 9/1973 | Wheeler | 261/78.2 |
| 4,674,888 | A * | 6/1987 | Carlson | 366/337 |
| 5,356,533 | A * | 10/1994 | Nakagawa | 210/123 |
| 5,842,600 | A * | 12/1998 | Singleterry et al. | 222/1 |
| 6,494,228 | B2 * | 12/2002 | Guillaume et al. | 137/209 |
| 2003/0168754 | A1 * | 9/2003 | Spiegel et al. | 261/94 |
| 2004/0238975 | A1 * | 12/2004 | Sakakibara et al. | 261/100 |
| 2005/0124772 | A1 * | 6/2005 | Royer et al. | 526/242 |

FOREIGN PATENT DOCUMENTS

| | | | |
|---|---|---|---|
| JP | 63-242258 | A | 10/1988 |
| JP | 5-123553 | A | 5/1993 |
| JP | 6-137670 | A | 5/1994 |
| JP | 08-019784 | A | 1/1996 |
| JP | 9-173803 | A | 7/1997 |
| JP | 2002-166148 | A | 6/2002 |
| JP | 2004-136272 | A | 5/2004 |

* cited by examiner

*Primary Examiner*—Scott Bushey
(74) *Attorney, Agent, or Firm*—Fitch, Even, Tabin & Flannery

(57) ABSTRACT

A process for producing carbonated water having a high concentration, inexpensively and easily, involves using a static mixer having 20 to 100 elements so as to provide a value Re×N of 100,000 to 2,000,000, in with Re represents a Reynolds number, when a mixture of water and carbonic acid gas flow in the static mixer.

3 Claims, 4 Drawing Sheets

EQUIPMENT AND PROCESS FOR THE PRODUCTION OF CARBONATED WATER

This Application is the National Phase of International Application No. PCT/2004/004453 filed Mar. 29, 2004, which designated the U.S. and was not published under PCT Article 21(2) in English, and this application claims, via the aforesaid International Application, the foreign priority benefit of and claims the priority from Japanese Application No. 2003-099184, filed Apr. 2, 2003, and from Japanese Application No. 2003-421355, filed Dec. 18, 2003, the complete disclosures of which are incorporated herein by reference.

TECHNICAL FIELD

The present invention relates to production equipment and a production process for carbonated water. More specifically, it relates to production equipment and a production process for carbonated water, for efficiently obtaining high-concentration carbonated water.

BACKGROUND ART

Since carbonated water has an excellent heat retaining effect, it has been used from the old days at a bathhouse utilizing a hot spring or the like. It is considered that the heat retaining effect of the carbonated water is owing to an improvement of a body environment according to a peripheral vasodilator action of a contained carbonic acid gas. Moreover, by a percutaneous introduction of the carbonic acid gas, an increase and an expansion of a capillary bed is brought about so as to improve a blood circulation to the skin. Therefore, it is said to be effective for a retrogressive lesion and a capillary circulation disorder.

Recently, particularly for a treatment mentioned above, it has been revealed that a further remarkable effect can be obtained when a carbonic acid gas concentration in the carbonated water is about 1,200 mg/L, which is a supersaturated concentration range in the water of about 40° C.

As production processes for the carbonated water, there are an one pass supply type for producing the carbonated water by passing hot water obtained from a hot water supplying device or the like in a carbonic acid gas dissolving device only one time, a circulation supply type of circulating hot water in a bath by a circulating pump via a carbonic gas dissolving device, and a dispersion type of directly dispersing a carbonic acid gas in hot water in a bath or the like.

Moreover, as processes for efficiently obtaining high-concentration carbonated water, a process of using a static mixer (see Japanese Patent Application Laid-Open (JP-A) Nos. 63-242258 and 63-242257), and a process of dissolving a carbonic acid gas in hot water via a hollow fiber membrane (see JP-A No. 8-19784) are known.

Although the static mixer is accessible inexpensively and thus it is advantageous, high-concentration carbonated water cannot be produced unless dissolving conditions such as a number of elements and water passage conditions can be controlled. According to the above-mentioned JP-A No. 63-242258, only a static mixer having 12 elements is disclosed without discussion of a kind of the static mixer or the like, and thus carbonated water of the high-concentration cannot be produced efficiently.

Moreover, according to an example of the above-mentioned JP-A No. 63-242257, as long as 30 minutes of time is required for obtaining 1,000 mg/L carbonic acid gas concentration in hot water of 200 L as a standard bath capacity. In order to shorten the time, there is a method of increasing a carbonic acid gas flow rate, however, since a dissolving efficiency is lowered, it is not preferable.

According to the process of using the hollow fiber membrane of the above-mentioned JP-A No. 8-19784, even though carbonated water of a higher concentration can be produced compared with the process of using the static mixer, it tends to be relatively expensive.

An object of the present invention is to provide equipment and a process for producing the carbonated water, capable of producing high-concentration carbonated water easily and efficiently.

DISCLOSURE OF THE INVENTION

A basic configuration of equipment for producing carbonated water according to the present invention includes that water supplying means, carbonic acid gas supplying means and a static mixer having 20 to 100 elements are provided and that the carbonic acid gas is dissolved in water by supplying water and a carbonic acid gas at a same time to the static mixer using the supplying means for water and a carbonic acid gas. By using the static mixer having 20 to 100 elements, high-concentration carbonated water can be obtained in a short time in spite of its relative inexpensiveness.

It is preferable that the water supplying means comprises a water vessel and a plurality of circulation pumps for circulating the water in the water vessel via the static mixer, and the plurality of the circulation pumps are connected in series so as to make pressure higher which is needed for a liquid transmission. Moreover, since a liquid transmission pump can be miniaturized by using a plurality of liquid transmission pumps connected in series for supplying a same amount of water compared with a case of using a single liquid transmission pump, a total electric capacity can be made smaller and a noise can be made lower, and furthermore, the equipment itself can be miniaturized so as to facilitate a maintenance.

It is preferable that a gas-liquid separator is disposed downstream of the static mixer. By providing the gas-liquid separator on a latter stage of the static mixer, a undissolved carbonic acid gas can be discharged outside a flow path beforehand, therefore a trouble cannot be generated in terms of a gas addition performance.

Moreover, carbonated water of a higher concentration can be produced further effectively by providing a value Re×N of 100,000 to 2,000,000, wherein N is a number of elements of the static mixer and Re is a Reynolds number at the time of having a mixture of water and a carbonic acid gas flow in the static mixer.

Moreover, with a premise that a flow rate of the carbonic acid gas to be supplied is X (L/min) and a flow rate of the water to be supplied is Y (L/min), it is preferable to set a value X/Y in a range of 0.5 to 1.2 in a case of supplying a mixture of the water and the carbonic acid gas to the static mixer for only one time, and to set a value X/Y in a range of 0.3 to 1.0 in a case of supplying a mixture of the water and the carbonic acid gas while circulating, respectively, so that the carbonated water of a high-concentration can be obtained efficiently.

BEST MODE FOR CARRYING OUT THE INVENTION

Hereinafter, preferable embodiments of the present invention will be explained in detail with reference to the drawings.

Figure 1:
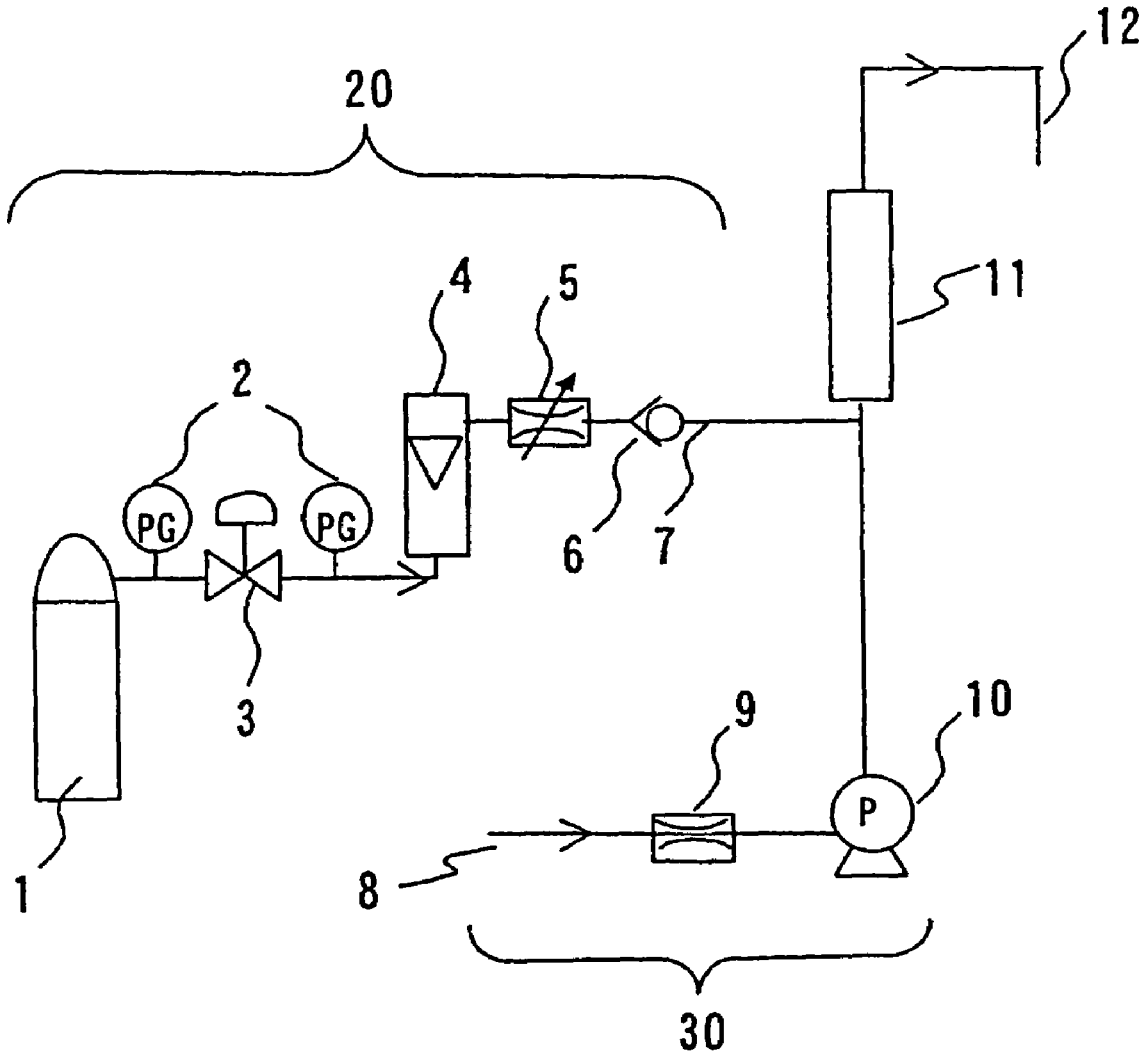
FIG. 1 is a schematic diagram showing an example of equipment for producing carbonated water of the present invention.

FIG. 1 is a schematic diagram showing an example of equipment for producing carbonated water of the present invention. According to this embodiment, a configuration of a carbonated water production equipment by supplying a mixture of water and a carbonic acid gas to a static mixer only one time (hereinafter, it is referred to as the one pass supply) is shown. Produced carbonated water may be received in a glass to drink, or may be used for shower through a showerhead.

The equipment for producing the carbonated water of this embodiment comprises a carbonic acid gas supplying means 20, a water supplying means 30 and a static mixer 11, wherein a carbonic acid gas from the carbonic acid gas supplying means 20 and water from the water supplying means 30 join together halfway so as to be supplied to the static mixer 11 for dissolving the carbonic acid gas in the water in the static mixer 11.

The carbonic acid gas supplying means 20 comprises a carbonic acid gas bomb 1 as a carbonic acid gas supply source, a carbonic acid gas pressure controlling valve 3 for reducing gas pressure at a certain pressure, a carbonic acid gas flow rate meter 4, a carbonic acid gas flow rate controlling valve 5 for controlling a gas flow rate, and a check valve 6. The carbonic acid gas is supplied from the carbonic acid gas supplying means 20 to the static mixer 11 through a carbonic acid gas inlet opening 7. Moreover, a carbonic acid gas pressure meter 2 is provided before and after the carbonic acid gas pressure controlling valve 3 for displaying pressure of the carbonic acid gas bomb 1 and carbonic acid gas supply pressure.

The carbonic acid gas flow rate meter 4 can be provided as needed for adjustment of the carbonic acid gas flow rate or confirmation of a correct flow rate.

Although the flow rate control of the carbonic acid gas may be carried out while using only the carbonic acid gas pressure control valve 3, it is preferable to carry out flow rate control while using the carbonic acid gas pressure control valve 3 and the carbonic acid gas flow rate control valve 5 in combination as shown in FIG. 1 in order to obtain a constant carbonic acid gas concentration.

As the carbonic acid gas flow rate control valve 5, various needle valves, orifices, piezoelectric or solenoid actuators used for electronic types or the like can be presented, and the needle valves are preferable for their inexpensiveness.

Water is heated appropriately to about 30° C. to 50° C. by a hot water supplier or the like so as to obtain hot water, and it is supplied by the water supplying means 30 from a water inlet opening 8 to the carbonated water production equipment. At this time, although it may be supplied utilizing an original pressure of the water line, it is preferable to use a pressure intensifying pump 10 since a necessary flow rate may not be supplied due to pressure loss of the static mixer 11 depending on a case. The pressure intensifying pump 10 is preferably a high lift type pressure intensifying pump, and particularly preferably a diaphragm pump for its inexpensiveness and high ability.

In a case a water supply amount is large due to an exceeding water supply pressure, the water supply amount can be maintained constant even in a case the water supply pressure fluctuates by controlling the water flow rate using a water constant flow rate valve 9, which prevents increase of the water flow rate to a certain level or higher.

A merging part of the carbonic acid gas and the hot water may be one permitting merging thereof, and thus a cheese piping, a cross piping, a union or the like, which are used as a common piping part, can be used.

The carbonic acid gas and the hot water are mixed in the static mixer 11 so that the carbonic acid gas is dissolved in the water. The static mixer 11 is a static type mixer without a driving part so that a mixing operation is carried out by dividing, inverting or changing a direction of a fluid by an element having a spiral shape, a baffle plate shape or the like, provided inside the pipe.

Details of the static mixer are mentioned in chapter 14 of "Progress of Chemical Engineering 34, Mixing Technology" compiled by The Society of Chemical Engineers, Japan, published by Maki Shoten.

As to a kind of the static mixer 11 used in the present invention, there are preferable ones for their inexpensively, for example, a Kenix type (it is also referred to as a spiral type) which has a spiral element twisted in a rightward direction and a spiral element twisted in a leftward direction disposed alternately in a pipe, and a stator type which has a shaft disposed at a center of a pipe and a semi elliptical baffle plate provided on the shaft.

In a case water is provided in the static mixer 11 by a same flow rate, the larger the number of elements N of the static mixer 11 becomes, the easier it can be mixed so that carbonated water having a higher carbonic acid gas concentration can be obtained. However, with a larger number of elements, while the carbonic acid gas concentration of the carbonated water to be produced has its limit, the pressure loss generated at the time of water passage is increased so that the water passage can be difficult.

According to the present invention, as the static mixer 11, one having the number of elements N of 20 to 100 is used.

Figure 2:
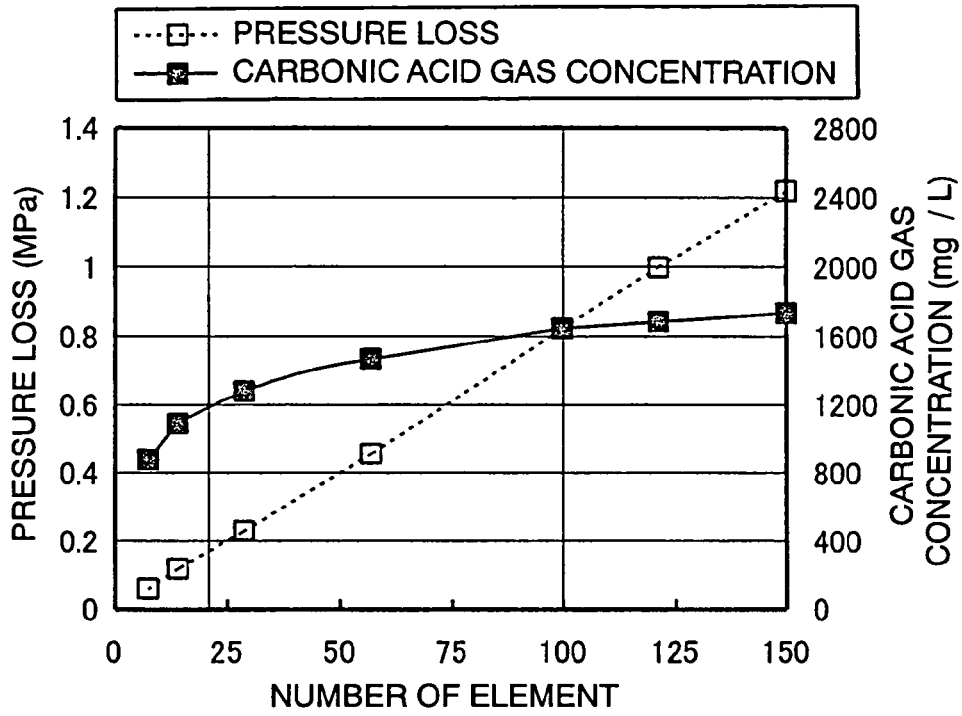
FIG. 2 is a graph showing an example of a relationship between a number of elements of a static mixer, and a carbonic acid gas concentration in carbonated water to be produced and pressure loss.

FIG. 2 shows a correlation example of the carbonic acid gas concentration in the produced carbonated water and the pressure loss with a premise that the water supply flow rate is 5 (L/min) and the carbonic acid gas supply flow rate is 4 (L/min) when the number of elements N of the static mixer 11 is changed in the one pass supply. The static mixer used is of the Kenix type (product name: DSP type) produced by Noritake Company Limited, having an inner diameter of 10 mm. As it is apparent from FIG. 2, with a number of elements N larger than 100, a carbonic acid gas concentration increasing ratio becomes lower and the pressure loss becomes higher.

On the other hand, with a number of elements N smaller than 20, a carbonic acid gas dissolving efficiency is lowered. In order to prevent a decline, it is necessary that turbulence is caused by increasing the water supply flow rate. As a result, there is a case that the pressure loss becomes larger, so that the water passage can be difficult.

Figure 3:
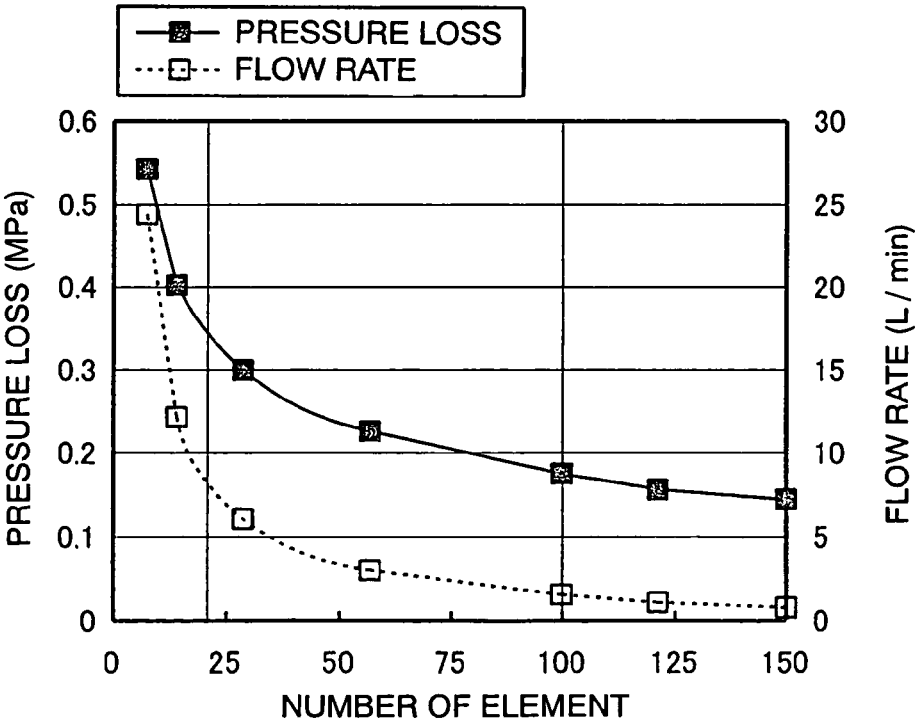
FIG. 3 is a graph showing an example of a relationship between a number of elements of a static mixer, and a flow rate of water to be supplied and pressure loss.

FIG. 3 shows a correlation example between the flow rate of the water necessary for having the carbonic acid gas concentration in the carbonated water to be produced to 1,340 (mg/L) and the pressure loss when the number of elements N of the static mixer is changed in the one pass supply. The static mixer used is of the Kenix type (product name: DSP type) produced by Noritake Company Limited, having an inner diameter of 10 mm. As it is apparent from FIG. 3, with a number of elements N smaller than 20, a large amount of water needs to be supplied and the pressure loss becomes drastically high.

From the above description, the lower limit of the number of elements N of the static mixer 11 needs to be 20 or more, and it is preferable to be 24 or more. Moreover, the upper limit of the number of elements N is preferably 100 or less, and it is more preferable to be 50 or less.

Although the static mixer 11 can be used alone, a plurality of them may be used by interlocking in series. The number of elements N in a case of interlocking the same in series refers to the number of elements present in one flow path. For example, in a case five sets of the static mixers 11 having seven elements per set are interlocked in series, the number of elements N is 35.

A plurality of the static mixers 11 may also be used by interlocking them in parallel. It is preferable to use the static mixers interlocked in parallel, since a carbonic water amount to be produced at one time can be increased while maintaining the pressure loss in a low state.

In a case they are interlocked in parallel, for example, even if five sets of the static mixers 11 having 20 elements per set are interlocked in parallel, the number of elements N is 20.

If the inner diameter of the static mixer 11 used in the present invention is too narrow, the pressure loss becomes so high that the water passage by a large flow rate is disabled. Thus, the lower limit of the inner diameter is preferably 5 mm or more, and it is more preferably 10 mm or more.

Moreover, under a condition with a constant water supply flow rate, when the inner diameter of the static mixer 11 becomes larger, the carbonic acid gas concentration in the carbonated water to be produced tends to be lowered and thus, the water supply flow rate needs to be increased in order to produce the high-concentration carbonated water.

Figure 4:
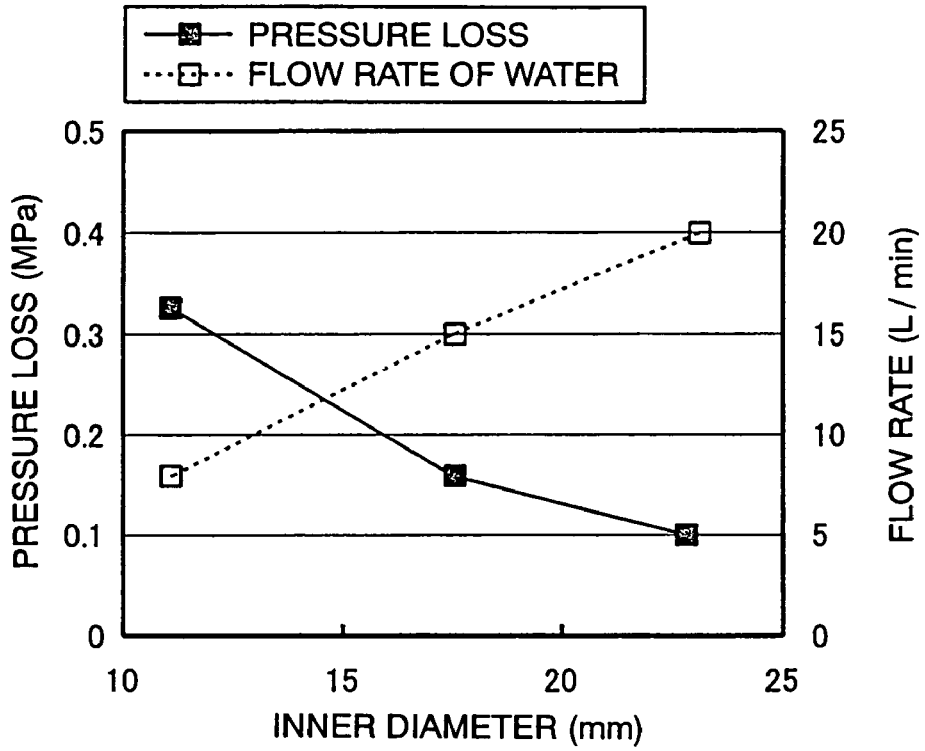
FIG. 4 is a graph showing an example of a relationship between an inner diameter of a static mixer, and a water flow rate and pressure loss.

FIG. 4 shows a correlation example between the inner diameter of the static mixer 11, the water flow rate necessary for maintaining the carbonic acid gas concentration in the carbonated water to be produced to about 1,200 (mg/L), and the pressure loss at that time in the one pass supply. A proportion of the carbonic acid gas supply flow rate and the water supply flow rate is provided constantly at 0.8, and the static mixer used is of a stator type (product name: 5 series) produced by TAH Industries Corp., having 28 elements.

As it is learned from FIG. 4, with a larger inner diameter of the static mixer 11, even in a case the water supply flow rate is increased, the water pressure loss tends to be lowered.

However, if the water flow rate needed to be supplied is too high, the carbonated water production equipment becomes large. Thus, the upper limit of the inner diameter is preferably 100 mm or less, and it is more preferably 50 mm or less.

At supplying the mixture of the water and the carbonic acid gas to the static mixer, it is preferable that the following formula (1) is satisfied between a Reynolds number commonly used as an indicator representing a fluid disturbance degree (Re) and the number of elements N of the static mixer so as to efficiently produce the carbonated water of a high-concentration.

$$100{,}000 \leqq Re \times N \leqq 2{,}000{,}000 \quad (1)$$

In a case hot water and a carbonic acid gas are mixed by the static mixer, the Reynolds number Re is calculated according to the formula below:

$$Re = 21{,}200\ Q/D\mu$$

Here, Q is a hot water flow rate (L/min), D is the inner diameter of the static mixer (mm), and μ is a viscosity of the water (mPa·s). For example, in a case of water of 40° C., the viscosity of the water is 0.65 mPa·s.

The table 1 shows a relationship example of a value Re×N, the carbonic acid gas concentration in the carbonated water to be produced, the carbonic acid gas dissolving efficiency, and the pressure loss when the carbonic acid gas supply flow rate and the water supply flow rate are changed under the condition that the proportion of the carbonic acid gas supply flow rate to the water supply flow rate is at 0.8. The static mixer used is of the Kenix type (product name: DSP type) produced by Noritake Company Limited, having 28 elements and an inner diameter of 10 mm. Moreover, the dissolving efficiency is calculated by a formula below:

Dissolving efficiency (%)=carbonic acid gas amount in the carbonated water/carbonic acid gas amount used×100

TABLE 1

| Carbonic acid gas flow rate (L/min) | Water flow rate (L/min) | Re × N | Carbon dioxide concentration (mg/L) | Dissolving efficiency (%) | Pressure loss (MPa) |
|---|---|---|---|---|---|
| 0.8 | 1 | 91000 | 820 | 51 | 0.02 |
| 2.4 | 2 | 183000 | 1020 | 63 | 0.06 |
| 4.8 | 6 | 548000 | 1340 | 83 | 0.28 |
| 8.0 | 10 | 913000 | 1480 | 92 | 0.62 |
| 20.0 | 25 | 2283000 | 1750 | 100 | 2.26 |

In a case the value Re×N is less than 100,000, the dissolving efficiency of the carbonic acid gas tends to be small. Preferably, the lower limit of the value Re×N is 200,000.

In a case the value Re×N is more than 2,000,000, the water passage may be difficult due to a large pressure loss. Preferably, the upper limit of the value Re×N is 1,000,000 or less, and it is more preferably 500,000 or less.

Moreover, in the one pass supply, with a premise that the flow rate of the carbonic acid gas to be supplied is X (L/min) and the flow rate of the water to be supplied is Y (L/min), it is preferable to satisfy the following formula (2) for producing the carbonated water of a high-concentration further efficiently.

$$0.5 \leqq X/Y \leqq 1.2 \quad (2)$$

Figure 5:
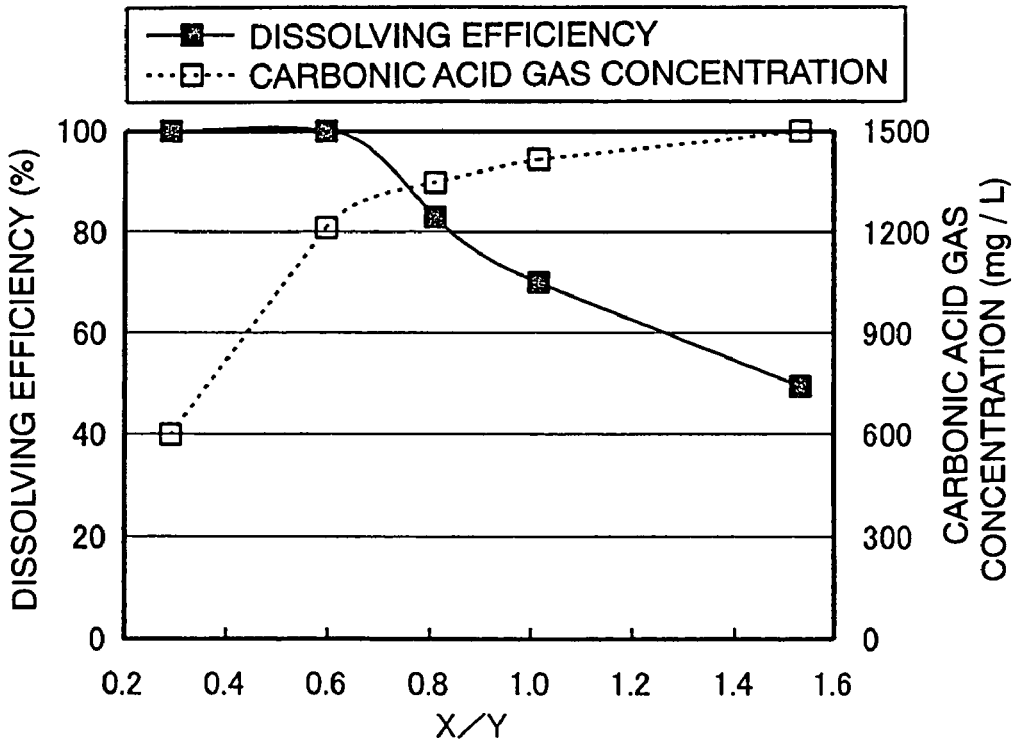
FIG. 5 is a graph showing an example of a relationship between a carbonic acid gas concentration in carbonated water to be produced and a dissolving efficiency at the time of changing a proportion of a water flow rate Y and a carbonic acid gas flow rate X.

FIG. 5 shows a correlation example between the carbonic acid gas concentration of the carbonated water to be produced and the dissolving efficiency when changing the flow rate of the carbonic acid gas X with the flow rate of the water Y fixed at 6 (L/min) in the one pass supply. The static mixer used is of the Kenix type (product name: DSP type) produced by Noritake Company Limited, having 28 elements and an inner diameter of 10 mm.

If the value X/Y is less than 0.5, it becomes difficult to increase the carbonic acid gas concentration in the carbonated water, and thus it is not preferable. The lower limit of the value X/Y is preferably 0.5 or more, and it is more preferably 0.6 or more. If the value X/Y is more than 1.2, the dissolving efficiency of the carbonic acid gas tends to be lowered. The upper limit of the value X/Y is preferably 1.2 or less, and it is more preferably 1.0 or less.

Figure 6:
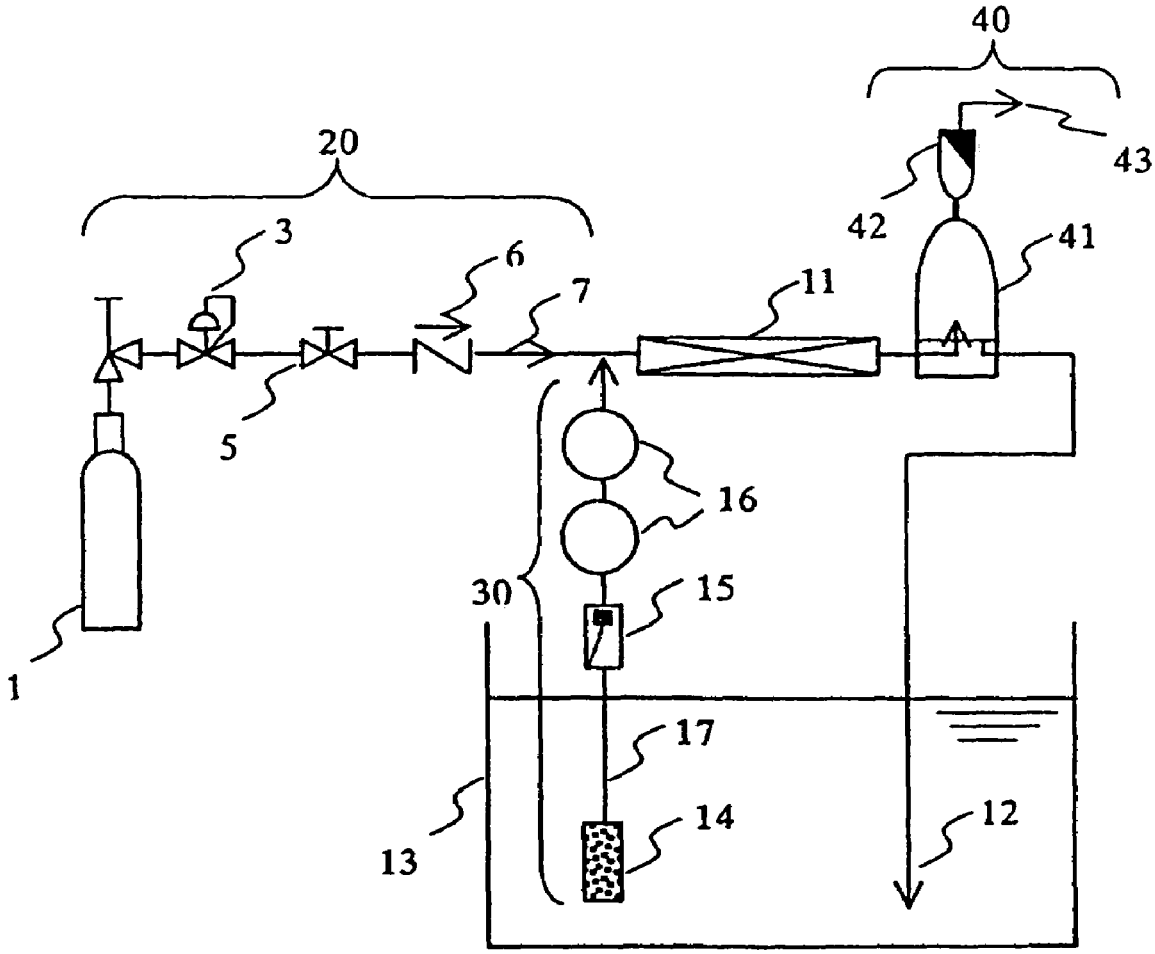
FIG. 6 is a schematic diagram showing another example of equipment for producing carbonated water of the present invention.

FIG. 6 schematically shows another embodiment of carbonated water production equipment of the present invention, showing a configuration of equipment for circulating water in a water vessel 13 by a circulation pump 16 via a static mixer 11 (hereinafter, it is referred to as a circulation supply). An equipment configuration is suitable for an application of using a large amount of the carbonated water such as whole body bathing with the carbonated water or the like.

The carbonic acid gas supplying means 20 comprises the carbonic acid gas bomb 1 as the carbonic acid gas supply source, the carbonic acid gas pressure controlling valve 3 for reducing the gas pressure at a constant pressure, the carbonic acid gas flow rate controlling valve 5 for controlling the gas flow rate, and the check valve 6. The carbonic acid gas is merged into a water flow line by the carbonic acid gas supplying means 20.

As the carbonic acid gas flow rate control valve 5, various needle valves, orifices, piezoelectric or solenoid actuators used for the electronic types or the like can be presented, and the needle valves are most preferable for their inexpensiveness.

The water in the water vessel 13 is supplied to the static mixer 11 via the water supplying means 30 comprising a filter 14, a flow switch 15 and a liquid transmission pump 16.

The carbonic acid gas and the water supplied to the static mixer 11 becomes the carbonated water after being mixed and agitated in the static mixer 11. The carbonated water is discharged from a carbonated water discharge opening 12 into the water vessel 13 so that the carbonic acid concentration in the water in the water vessel 13 is increased.

Although the filter 14 at a top end of a water supply line 17 from a bath tub is not essential, it is for trapping large dusts included in the hot water such as hair for preventing pollution in a circulation circuit, and a sponge, a metal mesh, a sintering agent or the like can be used therefor. A pore diameter is preferably fine, however, if it is too fine, a resistance is increased, and thus it is preferably between several tens of μm to several hundreds of μm.

A kind of the liquid transmission pump 16 is not particularly limited, however, a centrifugal pump is preferable in terms of quietness, cost, size or the like. A brushless pump is preferable for the liquid transmission pump 16, since an electromagnetic noise discharge amount is small and a life thereof is long.

Furthermore, a self vacuuming type pump is preferable for the liquid transmission pump 16, since it can be operated even in a case the water is not present in the water supply line 17 from the bath tub at the time of starting an operation. As the self vacuuming type pump, for example, a volume type liquid transmission pump such as a gear pump, a non volume type pump, or a liquid transmission pump with the water staying in a pump head even when the operation is stopped can be used.

Although the liquid transmission pump 16 can be used alone, using a plurality of the liquid transmission pumps 16 connected in series is preferable since the pressure necessary for the liquid transmission can be made higher. If the plurality of the liquid transmission pumps 16 connected in series are used, compared with a case of using a single liquid transmission pump 16 for supplying a same amount of water, the liquid transmission pump can be miniaturized, the total electric capacity can be made smaller and the noise can be made lower, and furthermore, the equipment itself can be miniaturized so as to facilitate the maintenance.

Although two liquid transmission pumps 16 are connected in series in an example shown in FIG. 6, three or more of the liquid transmission pumps 16 may be connected in series. It is also possible to connect two liquid transmission pumps 16 in series, and connect them with another liquid transmission pump 16 in parallel.

In a case a centrifugal pump or the like is used as the liquid transmission pump 16, a supply amount is largely fluctuated due to a fluctuation of a vacuuming pressure or a discharging pressure caused by a blockage inside the water supplying means 30 or the like so as to influence a dissolving behavior of the carbonated water. Therefore, it is preferable to provide the flow switch 15 as water supply amount detecting means for detecting the supply amount. As the flow rate detecting means, it is preferable to use the flow switch 15 for operating a lead switch according to a movement of a float for outputting an OFF signal when the flow rate becomes a set value or less.

In obtaining the carbonated water by circulating the water inside the water vessel 13 such as a bath tub, if a large amount of bubbles of an undissolved carbonic acid gas is present in the water in the water vessel 13, the carbonic acid gas bubbles can be vacuumed from the water supply line 17 so as to cause an idle rotation of the liquid transmission pump 16 or an imbalance of the water supply amount and the carbonic acid gas supply amount to the static mixer 11. Therefore, it is preferable to provide a gas-liquid separator 40 on a downstream side of the static mixer 11.

As the gas-liquid separator 40, for example, a method of contacting the water and atmosphere via a hydrophobic porous film for taking out the bubbles from the water, a method of lowering the flow rate for separating the water to downward and the carbonic acid gas to upward by utilizing a density difference of the water and the bubbles or the like can be adopted, and the method of separating the gas and the liquid by utilizing the density difference of the water and the bubbles is simple and preferable.

In the example shown in FIG. 6, the gas-liquid separator 40 comprises a container 41, an air bent valve 42, and an undissolved carbonic acid gas discharging line 43. Since the carbonated water including the undissolved carbonic acid gas introduced into the container 41 has the flow speed lowered due to a widening of a flow path in the container 41, the carbonated water and the carbonic acid gas are separated to downward and upward respectively due to the density difference of the water and the gas. Then, the carbonated water without bubbles runs out from an outlet provided in a lower part of the container 41, and the carbonic acid gas runs through the air bent valve 42 in an upper part so as to be discharged from the undissolved carbonic acid gas discharging line 43.

As a merging part of the carbonic acid gas and the hot water, anything such as a cheese piping, a cross piping, a union or the like, which are used as a common piping part may be used as long as it enables the merging.

According to the carbonated water production equipment and the production method of the present invention, the carbonated water of a high-concentration can be produced efficiently. The carbonated acid gas concentration in the carbonated water is preferably 900 mg/L or more for sufficiently exerting an effect of the carbonated water, and it is more preferably 1,000 mg/L or more. On the other hand, since the effect is not so different if the carbonic acid gas concentration becomes high to some extent, the upper limit is preferably 1,500 mg/L or less.

Moreover, as to a water temperature, in a case it is used for various kinds of bathing such as whole body bathing, partial bathing such as foot bathing, shower bathing or the like, it is preferable to have the temperature of the carbonated water to be produced in a range of 30 to 45° C. for providing the heat retaining effect and comfortable bathing, and it is more preferably in a range of 35 to 40° C.

Hereinafter, the present invention will be explained further specifically with reference to examples.

EXAMPLE 1

With 200 L of hot water placed in a bath tub, carbonated water was produced using a carbonated water production equipment of the configuration shown in FIG. 6. The dissolving efficiency was calculated by a formula below:

Dissolving efficiency (%)=carbonic acid gas dissolving amount in the carbonated water/carbonic acid gas amount used ×100

Using a static mixer of the Kenix type (number of elements of 24, inner diameter 25 mm Φ), the carbonated water production equipment was operated for 20 minutes with a water supply amount of 14 (L/min) and a carbonic acid gas flow rate of 7 (L/min). At this time, a value of the Reynolds number×number of elements N of the static mixer (hereinafter, it is mentioned as Re×N) was 438,351, a number of a water circulation was 1.4 times, and furthermore, a carbonic acid gas flow rate was X (L/min) and a water flow rate was Y (L/min).

A value of a proportion X/Y of the carbonic acid gas flow rate Y with respect to the water flow rate Y (hereinafter, it is simply mentioned as X/Y) was 0.5, and a pressure loss at the time of a water passage was 0.14 MPa.

The carbonic acid gas concentration of the obtained carbonated water was 1,000 (mg/L), and the dissolving efficiency was 73%.

EXAMPLE 2

Carbonated water was produced in a same manner as in the example 1 except that the water supply amount was 16 (L/min) and the carbonic acid gas flow rate was 8 (L/min). At this time, the value Re×N was 500,972, the number of the water circulation was 1.6 times, the value X/Y was 0.5, and the pressure loss at the time of the water passage was 0.18 MPa.

The carbonic acid gas concentration of the obtained carbonated water was 1,100 (mg/L), and the dissolving efficiency was 70%.

EXAMPLE 3

Carbonated water was produced in a same manner as in the example 2 except that a stator type static mixer (number of elements of 28, inner diameter 23 mm Φ) was used. At this time, the value Re×N was 635,291, the number of the water circulation was 1.6 times, the value X/Y was 0.5, and the pressure loss at the time of the water passage was 0.22 MPa.

The carbonic acid gas concentration of the obtained carbonated water was 1,150 (mg/L), and the dissolving efficiency was 73%.

EXAMPLE 4

Carbonated water was produced in a same manner as in the example 1 except that the carbonic acid gas flow rate was 8.4 (L/min).

At this time, the value Re×N was 438,351, the number of the water circulation was 1.4 times, the value X/Y was 0.6, and the pressure loss at the time of the water passage was 0.14 MPa.

The carbonic acid gas concentration of the obtained carbonated water was 1,100 (mg/L), and the dissolving efficiency was 67%.

EXAMPLE 5

Carbonated water was produced in a same manner as in the example 1 except that the carbonic acid gas flow rate was 5.6 (L/min) and an operation time was 30 minutes. At this time, the value Re×N was 438,351, the number of the water circulation was 2.1 times, the value X/Y was 0.4, and the pressure loss at the time of the water passage was 0.14 MPa.

The carbonic acid gas concentration of the obtained carbonated water was 1,200 (mg/L), and the dissolving efficiency was 73%.

EXAMPLE 6

Carbonated water was produced in a same manner as in the example 1 except that two sets of a Kenix type static mixers (number of elements of 24, inner diameter 13 mm Φ) were used in parallel with the water supply amount of 7 (L/min) per one static mixer, total 14 (L/min). At this time, the value Re×N was 421,491, the number of the water circulation was 1.4 times, the value X/Y was 0.5, and the pressure loss at the time of the water passage was 0.16 MPa.

The carbonic acid gas concentration of the obtained carbonated water was 1,000 (mg/L), and the dissolving efficiency was 73%.

EXAMPLE 7

Carbonated water was produced in a same manner as in the example 6 except that the water supply amount was 8 (L/min) per one static mixer, total 16 (L/min), and the carbonic acid gas flow rate was 8 (L/min). At this time, the value Re×N was 481,704, the number of the water circulation was 1.6 times, the value X/Y was 0.5, and the pressure loss at the time of the water passage was 0.22 MPa.

The carbonic acid gas concentration of the obtained carbonated water was 1,100 (mg/L), and the dissolving efficiency was 70%.

EXAMPLE 8

Carbonated water was produced in a same manner as in the example 1 except that the carbonic acid gas flow rate was 2.8 (L/min), and the operation time was 50 minutes. At this time, the value Re×N was 438,351, the number of the water circulation was 3.5 times, the value X/Y was 0.2, and the pressure loss at the time of the water passage was 0.14 MPa.

The carbonic acid gas concentration of the obtained carbonated water was 1,100 (mg/L), and the dissolving efficiency was 80%.

EXAMPLE 9

Carbonated water was produced in a same manner as in the example 1 except that the carbonic acid gas flow rate was 16.2 (L/min), and the operation time was 15 minutes. At this time, the value Re×N was 438,351, the number of the water circulation was 1.05 times, the value X/Y was 1.2, and the pressure loss at the time of the water passage was 0.14 MPa.

The carbonic acid gas concentration of the obtained carbonated water was 1,200 (mg/L), and the dissolving efficiency was 48%.

COMPARATIVE EXAMPLE 1

Carbonated water was produced in a same manner as in the example 1 except that a Kenix type static mixer (number of elements of 4, inner diameter 126.6 mm Φ) was used with the water supply amount of 15 (L/min), the carbonic acid gas flow rate of 6 (L/min) and the operation time of 30 minutes. At this time, the value Re×N was 15,458, the number of the water circulation was 2.25 times, the value X/Y was 0.4, and the pressure loss at the time of the water passage was 0.05 MPa.

The carbonic acid gas concentration of the obtained carbonated water was 1,000 (mg/L), and the dissolving efficiency was 55%.

COMPARATIVE EXAMPLE 2

Carbonated water was produced in a same manner as in the example 1 except that a Kenix type static mixer (number of elements of 120, inner diameter 25 mm Φ) was used. At this time, the value Re×N was 2,191,754, the number of the water circulation was 1.4 times, the value X/Y was 0.5, and the pressure loss at the time of the water passage was 0.64 MPa.

The carbonic acid gas concentration of the obtained carbonated water was 1,250 (mg/L), and the dissolving efficiency was 90%.

The invention claimed is:

1. A process for producing carbonated water, wherein a carbonic acid gas is dissolved in water by supplying the water and the carbonic acid gas to a static mixer having N number of elements, wherein N is 20 to 100; and wherein the condition according to formula (1) is satisfied with the premise that the Reynolds number Re when a mixture of water and carbonic acid gas flows in the static mixer:

$$100{,}000 \leqq Re \times N \leqq 2{,}000{,}000 \quad (1).$$

2. The process for producing the carbonated water according claim 1, wherein a formula (2) is satisfied with a premise that the carbonated water is produced by supplying the mixture of the water and the carbonic acid gas to the static mixer for only one time, a flow rate of the carbonic acid gas to be supplied is X (L/min) and a flow rate of the water to be supplied is Y (L/min):

$0.5 \leqq X/Y \leqq 1.2$(2).

3. The process for the carbonated water according to claim 1, wherein a formula (3) is satisfied with a premise that the carbonated water is produced by circulating the water in a water vessel via the static mixer, the flow rate of the carbonic acid gas to be supplied is X (L/min) and the flow rate of the water to be supplied is Y (L/min):

$$0.3 \leqq X/Y \leqq 1.0 \quad (3).$$

* * * * *